United States Patent [19]

Luetzow

[11] 4,375,379

[45] Mar. 1, 1983

[54] PROCESS OF MAKING A MULTIPLE CONDUCTOR FLEXIBLE WIRE CABLE

[75] Inventor: Edwin J. Luetzow, Northfield, Minn.

[73] Assignee: Teltec, Inc., Farmington, Minn.

[21] Appl. No.: 260,294

[22] Filed: May 4, 1981

Related U.S. Application Data

[62] Division of Ser. No. 959,074, Nov. 9, 1978.

[51] Int. Cl.[3] ..... H01B 13/10; H01B 7/08

[52] U.S. Cl. ..... 156/52; 156/292; 156/324; 156/332; 174/72 A; 174/72 TR; 174/117 F; 428/77; 428/172; 428/379

[58] Field of Search ..... 156/52, 55, 292, 324, 156/332; 174/117 F, 36, 72 A, 72 TR; 428/77, 172, 379

[56] References Cited

U.S. PATENT DOCUMENTS

| | | | |
|---|---|---|---|
| 243,180 | 6/1881 | Ware | 174/36 |
| 252,262 | 1/1882 | Sawyer | 156/52 |
| 3,413,405 | 11/1968 | Myers | 174/36 |
| 3,523,844 | 8/1970 | Crimmins et al. | 156/52 |
| 3,775,552 | 11/1973 | Schumacher | 174/117 F X |
| 3,833,755 | 9/1974 | Soelberg | 156/52 X |
| 4,000,558 | 1/1977 | Cahill | 174/72 A X |
| 4,085,502 | 4/1978 | Ostman et al. | 156/55 X |
| 4,098,628 | 7/1978 | Walton | 156/52 |
| 4,116,516 | 9/1978 | Griffin | 339/17 F |
| 4,154,977 | 5/1979 | Verma | 174/117 F |

FOREIGN PATENT DOCUMENTS

| | | | |
|---|---|---|---|
| 344210 | 10/1904 | France | 174/72 TR |

*Primary Examiner*—Edward C. Kimlin
*Assistant Examiner*—Robert A. Dawson
*Attorney, Agent, or Firm*—Hugh D. Jaeger

[57] ABSTRACT

Flexible wire cable and the flexible wire cable by the steps of the process for manufacturing the flexible wire cable. The flexible wire cable interconnects between two spaced plurality of terminals. The terminals can be equally centered at opposing ends or can be spaced on different centers at opposing ends. A plurality of wire conductors are laminated between two sheets of insulation, each sheet having a thermosetting polyester adhesive coating, which partially and fully cures as a function of time-temperature-pressure. Each of the plurality of wire conductors are substantially surrounded internally one hundred and eighty degrees by each sheet of the insulation. The insulation is offset to provide an overlap at opposing ends or at only one end to provide a solder stop and controlled flexings of the wire conductors. In another embodiment, at least one metallic shield is laminated to one side of the insulation sheet with like thermosetting polyester adhesive coating on the metallic sheet which cures as a function of time-temperature-pressure. A drain wire extends the length of the metallic shield and is tinned so that it is subsequently conductively bonded to the metallic shield.

13 Claims, 10 Drawing Figures

PROCESS OF MAKING A MULTIPLE CONDUCTOR FLEXIBLE WIRE CABLE

This application is a division, of application Ser. No. 959,074, filed Nov. 9, 1978.

BACKGROUND OF THE INVENTION

1. Field of the Invention

The present invention relates generally to cable, and more particularly, pertains to a flat flexible wire cable.

2. Description of the Prior Art

Those concerned with cable for interconnecting two spaced pluralities of terminals such as between circuit boards have long recognized the need for a flexible wire circuit.

The prior art cables have been unsatisfactory in that the older prior art cables comprised a plurality of insulated wire conductors physically bonded together. Other prior art cables are comprised of a plurality of spaced conductors laminated between longitudinal sheets of insulation such as plastic which provided little flex in addition to being cumbersome and awkward. These prior art cables are denoted as ribbon cables in the art which generally are coiled onto rolls containing in excess of one hundred feet of cable. This prior art cable made wiring between two spaced pluralities of terminals of circuit boards in an electronic installation awkward as it was necessary to cut the desired length of the cable, separately strip each individual wire conductor, and physically connect each individual wire conductor to each terminal of either the circuit board or to connector. The prior art flat cables permitted little flexing of any of the wire conductors of the cable thereby making subsequent soldering to either circuit boards and terminals difficult.

The prior art cables also failed to provide a solder stop for each individual wire conductor and as a consequence, the integrity of the cable was affected during the soldering process by the presence of hot molten solder. Usually, the temperature of soldering process was in excess of the breakdown temperature of the cable insulation and consequently, the wire conductors moved within the cable insulation causing short circuits against adjacent conductors. This was very unsatisfactory.

The prior art cables also have very minimum flexing at the wire conductor end of the cable which was soldered to the circuit board or the terminals. The flexing point for each wire conductor was very distinct resulting in breakage and difficulty in fastening each of the wire conductors, and provided no controlled flexing of the wire conductors at the end of the cable.

The present invention provides a flexible wire cable that overcomes the disadvantages of the prior art cables.

SUMMARY OF THE INVENTION

The general purpose of this invention is to provide a flat flexible wire cable and a process of making the same.

According to one embodiment of the present invention, there is provided a process of manufacturing a flat flexible wire cable comprising the steps of positioning wire conductors between spaced centers at each end, covering the positioned wire conductors with a sheet of insulation, having a thermosetting polyester adhesive coating, which is less than the longitudinal length of the wire conductors, partially curing the thermosetting polyester ahdesive under predetermined temperature-pressure to bond the sheet of insulation to each of the wire conductors, covering the other side of the wire conductors with a second sheet of like insulation, having a like thermosetting polyester adhesive coating which is less than the longitudinal length of the wire conductors, and fully curing the thermosetting polyester adhesive under predetermined temperature-pressure to bond the second sheet of insulation to the first sheet of insulation and the wire conductors whereby each sheet of the insulation substantially surrounds each of the wire conductors by one hundred and eighty degrees and channels are formed in each sheet of the insulation between each of the wire conductors and the ends of the wire conductors extend outwardly beyond the ends of the insulation sheets. The sheets of insulation, such as Mylar by way of example and for purposes of illustration only, overlap at least at one end to provide controlled flexing and a solder stop for ends of the wire conductors extending beyond the sheets of insulation. Metallic sheet having a like thermosetting polyester adhesive coating is bonded under predetermined temperature-pressure to the surface of one or both of the insulation sheets and a tinned drain wire, which extends longitudinally between the metallic sheet and the insulation sheet, is conductively bonded to the metallic sheet during the curing.

One significant aspect and feature of the present invention is a flexible wire cable which has utmost flexibility and can be manipulated in 360 degrees without affecting the embedded wire conductors, and further maintains the geometrical symmetry of each of the wire conductors with respect to the other wire conductors in the flexible wire cable.

Having briefly described one embodiment of the present invention, it is a principal object hereof to provide an improved flexible wire cable.

An object of the present invention is to provide a flexible wire cable and a process for manufacturing the flexible wire cable utilizing insulation sheets having a thermosetting polyester adhesive coating which bonds the insulation sheets to a plurality of wire conductors where the curing of the thermosetting polyester adhesive is a function of time-temperature-pressure.

Another object of the present invention is to provide a flexible wire cable which has at least one end where one of the insulation sheets overlaps the other to provide controlled flexing of the extending ends of the wire conductors and a solder stop.

A further object of the present invention is to provide a flexible wire circuit having a consistent distributed capacitance for each unit of length by providing a metallic shield on one or both sides of the flexible wire cable. The metallic shield is bonded to one sheet of the insulation with the like thermosetting polyester adhesive and includes a tinned drain wire extending longitudinally between the insulation sheet and the metallic shield. The drain wire is bonded to the metallic shield during the curing process of the thermosetting polyester adhesive as the tin in the drain wire bonds to the metallic shield as a function of time-temperature-pressure. The drain wire is subsequently connected to a suitable circuit point such as ground.

An additional object of the present invention is to provide a flexible wire cable where the wire conductors on either end of the flexible wire cable can be spaced on equal or unequal centers. By way of example and for purposes of illustration only, the wire conductor ends could be equally spaced at opposing ends on centers of 0.05 inches or in the alternative, the wires at one end could be spaced at one end on 0.10 inch centers, and on the other end on 0.05 inch centers.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein:

FIG. 1A illustrates a top view of wire conductors positioned around pins on a Teflon coated platen of a fixture press and an insulation sheet having a thermosetting polyester adhesive coating covering the wire conductors, the first and second steps of a process for manufacturing a flexible wire cable, the present invention;

DESCRIPTION OF THE PREFERRED EMBODIMENTS

Figure 2A:
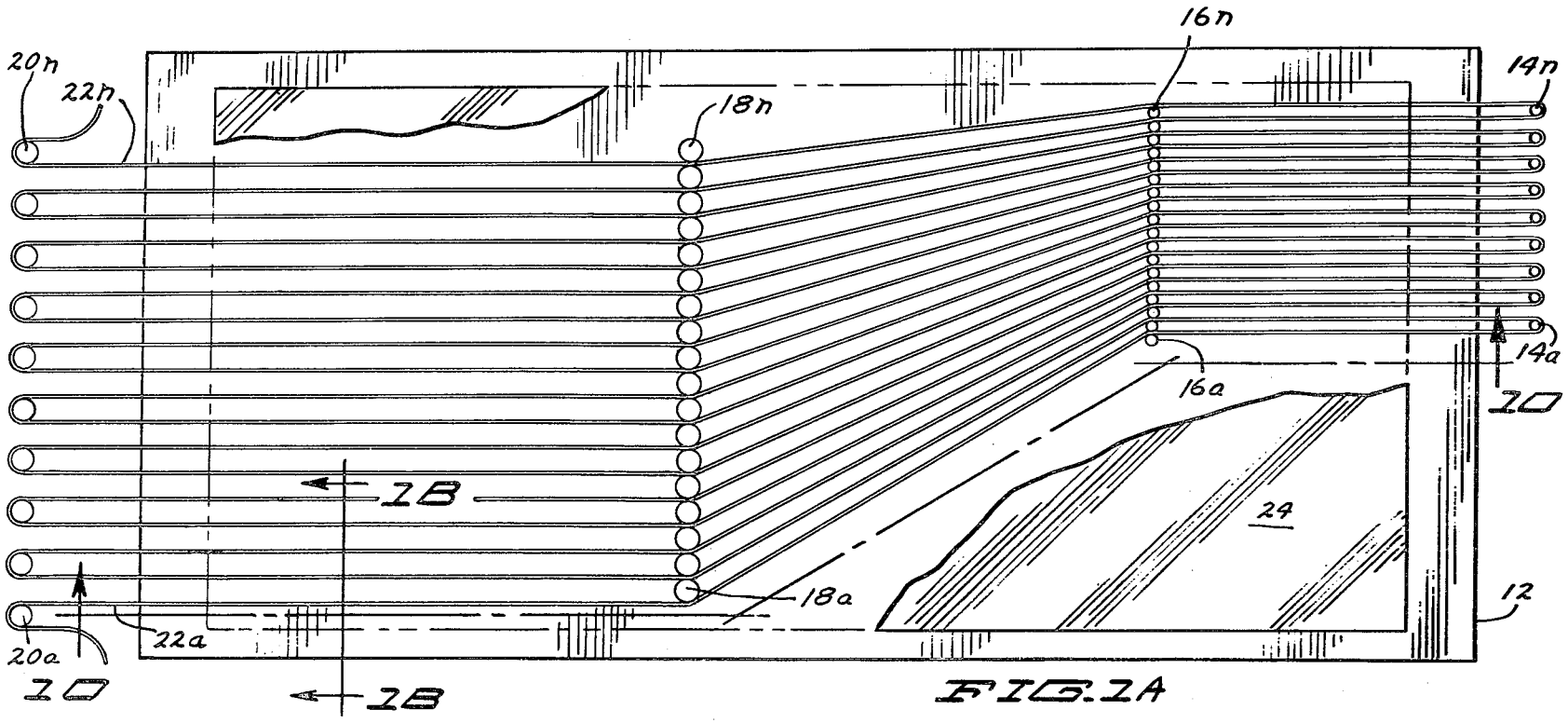
FIG. 2A illustrates a top view of the flexible wire cable with offset overlapping ends of the Mylar insulation sheet at opposing ends of the flexible wire cable.

FIG. 1 illustrates a product and steps of a process for manufacturing a flexible wire cable 10, the present invention.

FIG. 1A illustrates a top view of a Teflon coated bottom, platen 12 of a fixture press that further includes an elastomer coated top platen which is not illustrated. A plurality of pins 14*a*–14*n*, 16*a*–16*n*, 18*a*–18*n*, and 20*a*–20*n* are positioned, as illustrated in the bottom platen 12 to fan out from 0.05 inch centers at the right end to 0.10 inch centers at the left end. The number "n" of the plurality of pins 14–20 and the particular spacing and positioning of the pins 14–20 in the platen 12 is illustrated in the figure by way of example and for purposes of illustration only, and is not to be construed as limiting in any sense. Wire conductors 22*a*–22*n* extend alternately around pins 14–20 as illustrated in the figure. A sheet of insulation 24, such as Mylar by way of example and for purposes of illustration only having a coating 25 of thermosetting polyester adhesive such as readily available G. T. Sheldahl Company Number 341, is positioned on top of the bottom teflon coated platen 12, over the pins 14–20, and over the wire conductors 22. The longitudinal length of the insulation sheet 24 is less than the longitudinal length of the wire conductors 22 so that the ends of the wire conductors 22 extend beyond the ends of the insulation sheet 24.

The fixture press is heated and closed to partially cure the thermosetting polyester adhesive which is a time-temperature-pressure function as now described. The curing function of the thermosetting polyester adhesive is asymptotic. In this example, the initial melt point of the thermosetting polyester adhesive is in the range of 225° F. and increases as the curing advances to the range of 275° F. The cure is approximately one hour in the range of 275° F. at a pressure of one hundred p.s.i. which provides for tacking of the wire conductors 22 to the insulation sheet 24 in the fixture press. In the event that any one of the three perimeters of time-temperature-pressure are varied, then the other perimeters are varied accordingly. Upon cooling to room temperature, the insulation sheet 24 having the embedded wire conductors 22 having formed the structure of FIG. 1B is peeled from the Teflon coated bottom platen 12 of the fixture press.

Figure 1B:
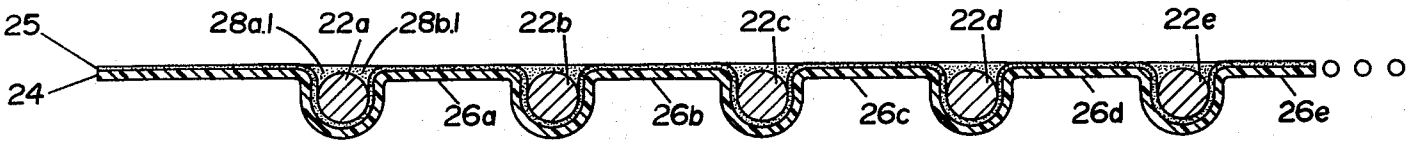
FIG. 1B illustrates a section taken on line 1B—1B of FIG. 1A looking in the direction of the arrows after bonding the sheet of insulation to the wire conductors.

FIG. 1B shows the wire conductors 22 embedded into insulation sheet 24 for substantially greater than 270° internally around each of the wire conductors 22 and channels 26*a*–26*n* are formed in between each of the wire conductors 22. The thermosetting polyester adhesive is now partially cured, and has a raised melting point of approximately 275°–300° F. because of the change of the molecular cross linking. The gaps between the wire conductors 22 and the Mylar insulation sheet 24 are now filled by the partially cured thermosetting polyester adhesive as illustrated by numerals 28.1 and 28b.1, etc.

A second sheet of insulation 30, such as Mylar, having a like coating 31 of thermosetting polyester adhesive positioned in overlapping offset relationship over the wire conductors 22 side of wire conductor 22-Mylar insulation sheet 24 configuration of FIG. 1B so that the ends of the insulation sheets 24 and 30 are offset. The insulation sheet 24-wire conductor 22-insulation sheet 30 of the flexible wire cable 10 is then positioned between two elastomer coated platens in a fixture press. The press is closed and platen pressure in the range of one hundred p.s.i. is applied. The elastom-- coated platens of the fixture press are heated to 290° F. at the rate of 150° F. temperature rise per hour to fully cure the thermosetting polyester adhesive. The press is held at 290° F. for one hour to assure that the entire elastomer coated platens are uniformly heated, and then the elastomer coated platens are subsequently cooled. After the temperature decreases to less than 150° F. on the platens, the press is opened and the flexible wire cable 10 of FIG. 1C removed. The wire conductors 22 are trimmed at each end of the flexible wire cable 10 to expose a suitable length of the wire conductors 22 as required, beyond the outer edge of the overlap of the insulation sheets 24 and 30 as later described in FIG. 1D.

Figure 1C:
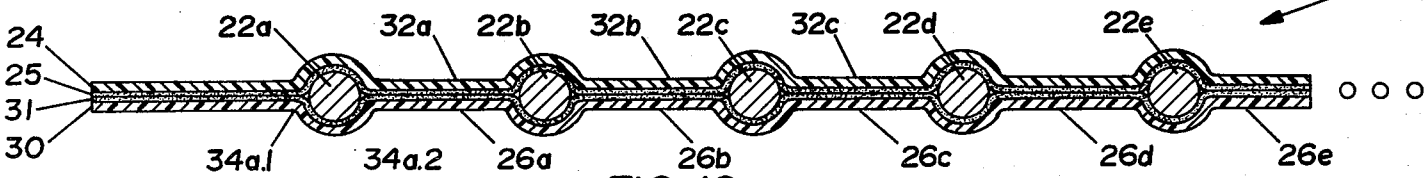
FIG. 1C illustrates an end view of the insulation sheet-wire conductor-insulation sheet flexible wire cable product.

FIG. 1C shows the wire conductors 22 embedded in between insulation sheets 24 and 30 and the opposing channels 26 and 32 formed in between the wire conductors. The wire conductors 22 are embedded internally and surrounded by the insulation sheets 24 and 30 for substantially 180 degrees as illustrated in the figure. Small gaps 43a.1 and 34a.2, etc., between the apex of the insulation sheets 24 and 30 and the wire conductors 22 are filled by the flow of the thermosetting polyester adhesive during curing.

Figure 1D:
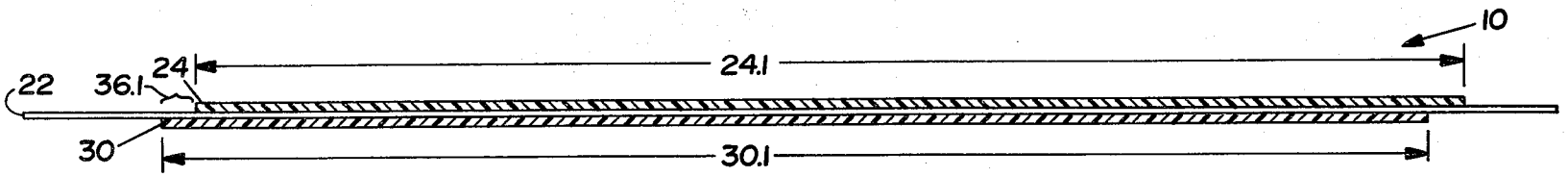
FIG. 1D illustrates a section taken on line 1D—1D of FIG. 1A looking in the direction of the arrows showing the offset overlapped ends of the insulation sheets.

FIG. 1D shows a wire conductor 22 positioned between the two sheets of insulation 24 and 30. Insulation sheets 24 and 30 are shown as of equal length 24.1 and 30.1. Insulation sheets 24 and 30 are offset in FIG. 1D with respect to each other to provide overlaps 36.1 and 36.2 at opposite ends of the flexible wire cable 10. While overlaps 36.1 and 36.2 are illustrated at opposing ends of the flexible wire cable 10, an overlap can be provided at either end as determined. The overlaps 36.1 and 36.2 allow substantial flexing of the ends of the wire conductors 22, and provide a solder stop. The flat fan out flexible wire cable 10 in FIG. 1A is now described in the context as a flat straight flexible wire cable 10 in FIG. 2A.

FIG. 2A, which illustrates a top view of the flexible wire cable 10, shows the insulation sheet 24 having a length 24.1 and the Mylar insulation sheet 30 having a length 30.1, the insulation sheets 24 and 30 being offset to each other over the wire conductors 22 to provide overlaps 36.1 and 36.2. The lengths 24.1 and 36.1 of the insulation sheets 24 and 30 can be of equal or unequal length, and are offset with respect to each other as illustrated in FIG. 2A and FIG. 2B to provide overlaps 36.1 and 36.2. The overlaps 36.1 and 36.2 provide for flexing of the ends of the wire conductors 22. In the alternative, an overlap can be provided at either one of the ends. The advantages of the overlap 36.1 and 36.2 are a solder stop formed by overlapping ends of the insulation sheets 24 and 30 in addition to providing integrity of the flexible wire cable 10 which is not affected by the temperature of the hot molten solder during the soldering which can be in excess of the breakdown temperature of the thermosetting polyester adhesive. Further, the overlaps 36.1 and 36.2 provide controlled flexing of the ends of the wire conductors 22 which is distributed over the length of the overlap of the ends of the wire conductors 22 rather than at a distinct flexure point which is normally the instance in the prior art cables.

FIG. 2B shows those elements previously delineated. Specifically, the overlaps 36.1 and 36.2 of the insulation sheets 24 and 30 are provided at opposing ends of the wire conductors 22.

Figure 3A:
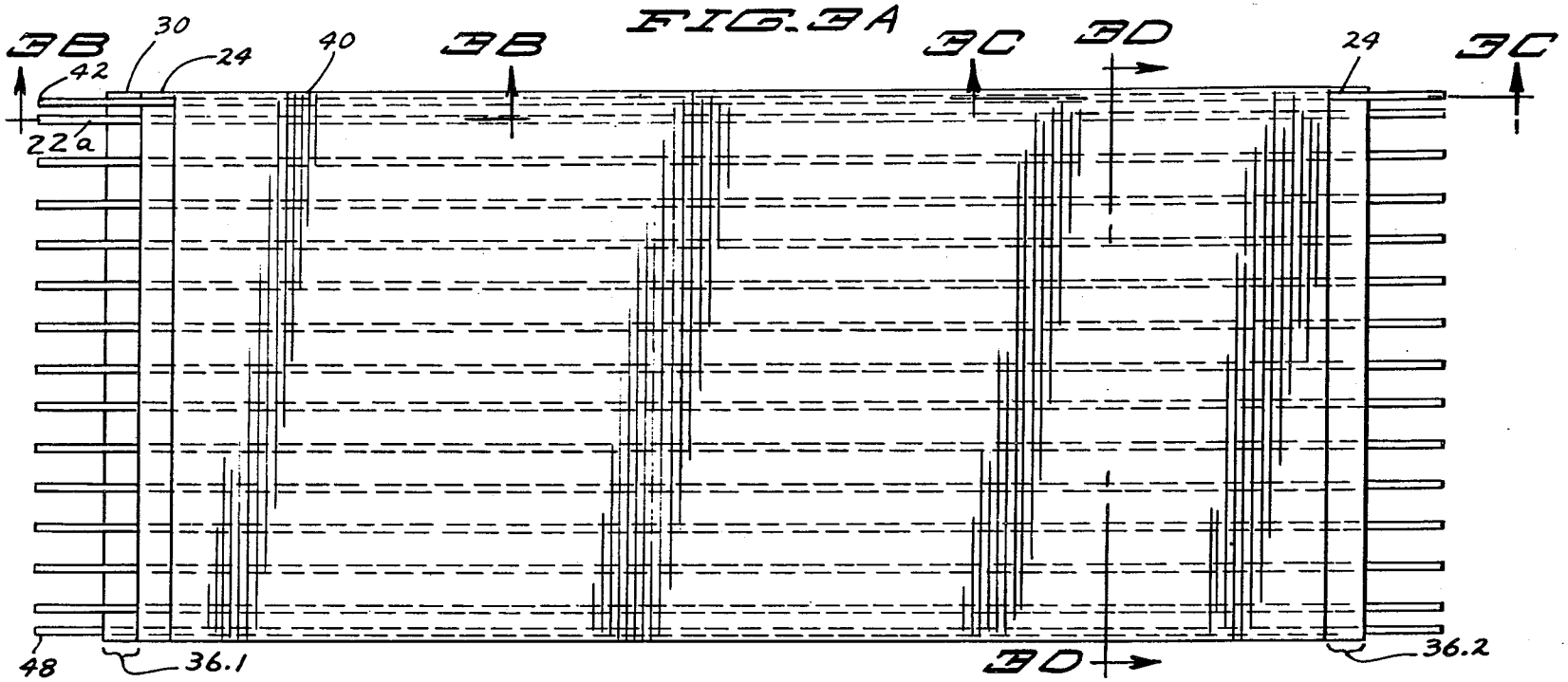
FIG. 3A illustrates a top view of an additional embodiment of the present invention with metallic shields on opposing sides of the flexible wire cables.

FIG. 3A shows a metallic shield 38, such as one-half ounce copper having a suitable exterior polyester insulating shield insulation 40 such as plastic, bonded over flexible wire cable 10 forming a shielded flexible cable 50. The metallic shield 38 is slightly shorter than the length 24.1 of the insulation sheet 24. A tinned drain wire 42 extends at least slightly beyond the longitudinal length of the metallic shield 38 and the insulation sheet 24. A like thermosetting polyester adhesive 39 is coated on the interior of the metallic shield 38 and cured so that the metallic shield 28 is bonded to the flexible wire cable 10 as previously described as a function of time-temperature-pressure; the range of 325°–350° F. for one hour at a pressure in the range of 50–100 p.s.i. The temperature and pressure over the time interval causes the impregnated solder in the tinned drain wire 42 to flow thereby solder tacking and electrically, conductively, bonding the drain wire 42 to the metallic shield 38. A bottom metallic shield 44 including like insulation 46 and a corresponding drain wire 48 is conductively bonded to the bottom of the flexible wire cable 10 as previously described where the drain wire 48 is electrically, conductively, bonded to the metallic shield 44.

Figure 3B:
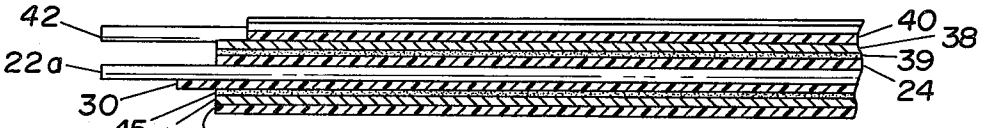
FIG. 3B illustrates a section of the additional embodiment taken on line 3B—3B of FIG. 3A looking in the direction of the arrows; and, FIG. 3C illustrates a section of the additional embodiment taken on line 3C—3C of FIG. 3A looking in the directions of the arrows.

FIG. 3B shows the wire conductor 22, the bottom insulation sheet 30, the bottom metallic shield 44, the plastic insulation 46, the top insulation sheet 24, the drain wire 42, the top metallic shield 38 and the plastic insulation 40.

Figure 3C:
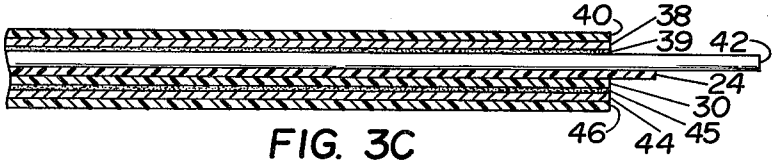
Figure 3D:
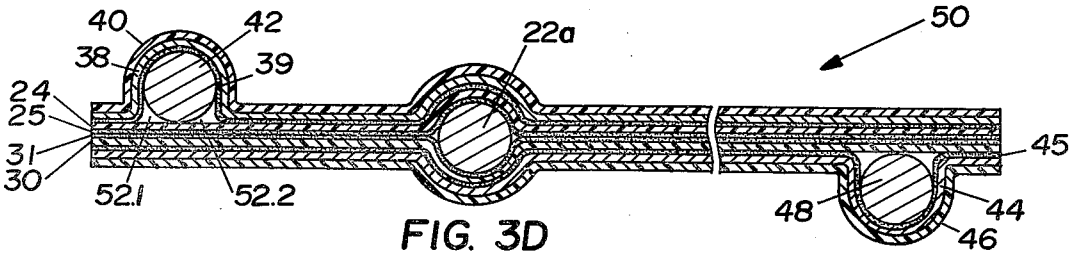

FIG. 3C shows the shielded flexible wire cable 50 with the two drain wires 42 and 48 on opposing sides of the insulation sheets 24 and 30 respectively. While the metallic shields 38 and 44 surround and bond to the drain wires 42 and 48 for substantially greater than 180 degrees, the metallic shields 38 and 44 surround the insulation sheets 24 and 30 around each wire conductor 22 for substantially 120 degrees, and conform to the insulation sheet around each wire conductor. The thermosetting polyester adhesive 45 flows and fills the gaps 52.1 and 52.2 between the insulation sheet 24, the metallic sheet 38, and the drain wire 42, etc.

The metallic shield is bonded to the insulation sheet as a function of time-temperature-pressure of one hundred p.s.i. at 350° F. for one hour.

PREFERRED MODE OF OPERATION

Figure 2A:
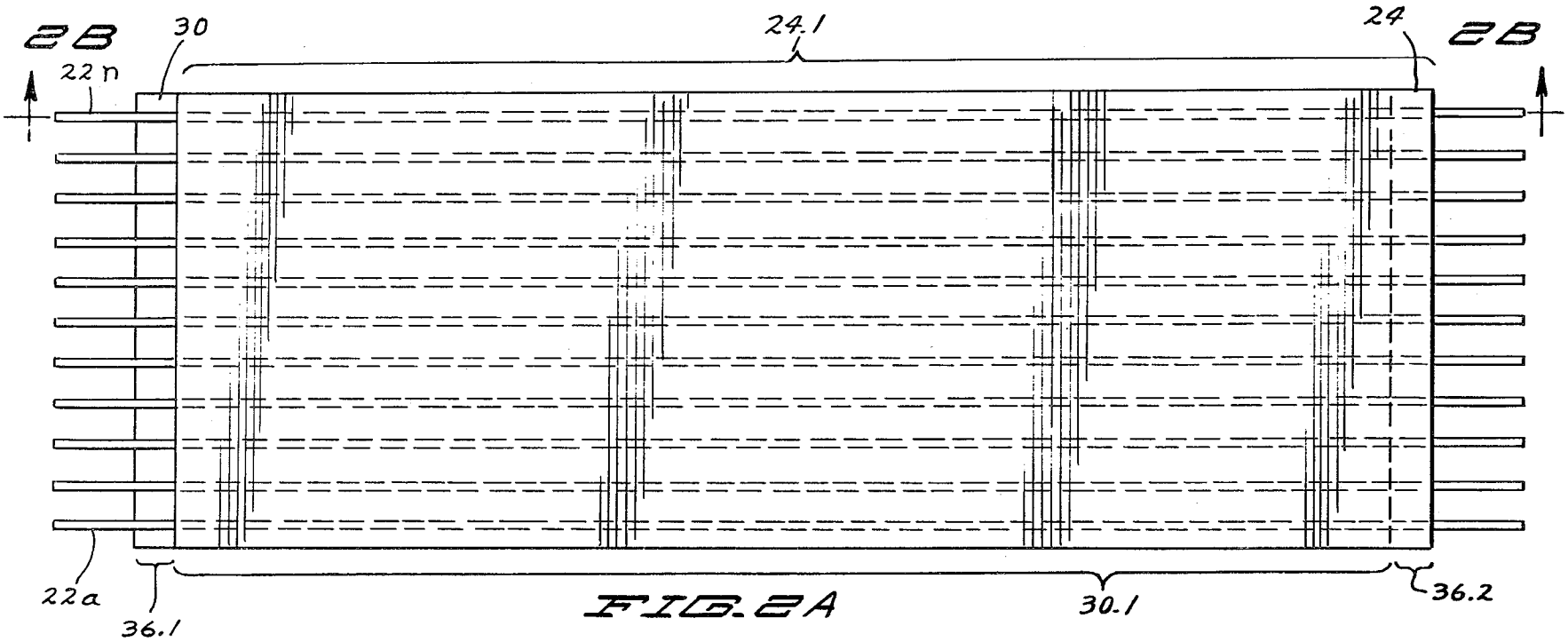
Figure 2B:
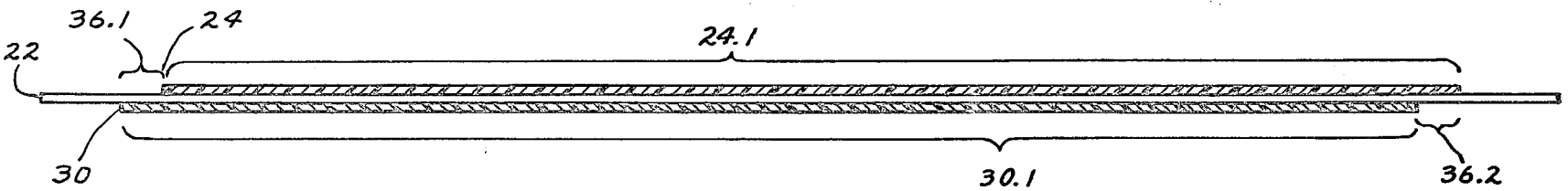
FIG. 2B illustrates a section taken on line 2B—2B of FIG. 2A looking in the direction of the arrows.

The flexible wire cable product 10 of FIGS. 1 and 2 can be manufactured according to the steps of the process as previously delineated in the above paragraphs. The process broadly comprises the steps of positioning a wire conductor 22 in a predetermined configuration as illustrated in FIG. 1; covering the wire conductor with a first sheet of insulation as illustrated in FIG. 1; bonding the first sheet of insulation to the wire conductor with a thermosetting polyester adhesive partially curing as a function of time-temperature-pressure as illustrated in FIG. 1B; covering the wire conductors 22 with a second sheet of insulation 30 and overlapping the longitudinal ends as predetermined, and; bonding the second sheet of insulation 30 to the wire conductors 22 with the thermosetting polyester adhesive fully curing as a function of time-temperature-pressure resulting in the flexible wire cable product 10 as illustrated in FIGS. 1C and 1D.

If the wire conductors 22 are positioned in the predetermined configuration of FIG. 2 in lieu of the fan out configuration of FIG. 1, then the wire conductors 22 can be wrapped and positioned on opposing sides of a rectangular mandrel. Sheets of insulation having the coated thermosetting polyester adhesive are positioned on each opposing side of the mandrel between the mandrel and the wire conductors. The assembly of the wrapped and positioned wire conductors around the insulation sheets positioned on opposing sides of the mandrel is then inserted into a press to tack the wire conductors to the insulation sheets as a function of time-temperature-pressure. The wire conductors are then cut and the insulation sheets having the tacked wire conductor falls unsupported from the mandrel. Finally, each of the wire conductors-insulation sheet assembly is covered with the opposing second insulation sheet having the ends of the opposing second insulation sheet overlapped as predetermined and subsequently the insulation sheet-wire conductors-insulation sheet assembly is bonded together as a function of time-temperature-pressure as previously described in the preceding paragraphs.

The flexible wire cable 10 of FIG. 2A illustrates equal center to center spacing of the wire conductors 22 and is comparable to the flexible wire cable 10 of FIG. 1A–1D having the fan out wire conductor configuration where the wire conductor 22 center to center spacing between opposing ends are offset such as for interconnecting two different circuit boards. The insulation sheets 24 and 30 have a width to conform to and slightly overlap the width of the outside positioned wire conductor 22. The insulation sheet overlaps 36.1 and 36.2 in the range of one-sixteenth inch to one-eighth inch of FIGS. 2A and 2B, and FIG. 1D provides a solder stop during the soldering process, and further provides that the integrity of the flexible wire cable 10 is not affected by the presence of solder. This is especially important so that the solder does not diffuse into the insulation sheets 24 and 30 causing a breakdown temperature of the insulation sheets 24 and 30 and subsequent displacement of the wire conductors 22. The overlap ends 36.1 and 36.2 also provides for controlled flexing of the ends of the wire conductors 22 which are distributed over each portion of the overlap ends 36.1 and 36.2 rather than at a distinct flexure point as in the prior art cables.

While overlaps 36.1 and 36.2 have been shown on opposing ends in the FIGS. 2A and 2B and FIG. 1D, overlaps can be provided at either one of the ends.

FIG. 3B illustrates the flexible wire cable 50 with the metallic shields 38 and 44 covering the top and bottom of the flexible wire cable 10. Longitudinal, tinned drain wires 42 and 48 are bonded to the longitudinal length of the metallic shield during the bonding process of the metallic shields to the insulation sheets as a function of time-temperature-pressure. The drain wires can be subsequently connected in the circuit to ground or any other point in the circuit as predetermined.

Flexible wire cable 50 can have only one metallic shield and drain wire bonded to the flexible wire cable of FIGS. 1 and 2 which particularly lends itself in application as a fixed capacitive voltage divider plasma multiplexed high frequency display cable, or can have two metallic shields and drain wires bonded to opposing sides of the flexible wire cable as illustrated in FIG. 3 which particularly lends itself in application as a finite impedance radio frequency transmission line conductor.

Various modifications can be made to the flexible wire cable of FIGS. 1–3 without departing from the apparent scope of the invention. The range of perimeters set forth in the specification for time-temperature-pressure are not to be construed as limiting in any sense as the range of perimeters has been disclosed as one embodiment of practicing the invention, and if one of the three perimeters are varied, the remaining two perimeters are proportionally varied accordingly. The temperatures set forth in the specification can be varied twenty-five degrees either side of the indicated range.

Having thus described the invention, what is claimed is:

1. The process for manufacturing a flexible wire cable comprising the steps of:

a. positioning wire conductors in a predetermined configuration;

b. positioning a first sheet of insulation including a thermosetting polyester adhesive coating over said wire conductors;

c. bonding said first insulation sheet as a first function of time, temperature, and pressure to said wire conductors and partially curing said adhesive;

d. positioning a second sheet of insulation including a coating of said thermosetting polyester adhesive over said wire conductors and opposing said first sheet of insulation, said sheets forming an offset and overlap at one or both ends of said sheets; and, e. bonding said second insulation sheet to said wire conductors and said first insulation sheet as a second function of time-temperature-pressure and fully curing said adhesive whereby each of said wire conductors are substantially surrounded 180° by each of said adhesive coatings and said insulation sheets and channels are formed in said insulation sheets between each of said wire conductors and said offset end provides a solder stop and controlled flexing of said wire conductors thereby providing a flexible wire cable about the offset end and about each conductor.

2. The process of claim 1 wherein said first function is pressure at one hundred p.s.i. at a temperature of 275° F. for one hour.

3. The process of claim 1 wherein said second function is pressure at one hundred p.s.i. at a temperature of 290° F. per hour, and subsequent cooling to a temperature of 150° F.

4. The process of claim 1 wherein said sheets of insulation are of different longitudinal length.

5. The process of claim 1 wherein positioning said second sheet of insulation forms an offset and overlap at both ends of said first insulation sheet whereby said offset and overlap provides a solder stop and controlled flexing of said wire conductor.

6. The process of claim 1 wherein said sheets of insulation are of equal lengths.

7. The process of claim 1 wherein said insulation sheets are Mylar.

8. The process of claim 1 wherein said thermosetting polyester adhesive is of a type where molecular cross linking changes occur during curing.

9. The process of claim 1 comprising the positioning of said wire conductors on equal centers.

10. The process of claim 1 comprising the positioning of said wire conductors in a fan-out configuration.

11. The process of claim 1 comprising:

a. positioning a tinned drain wire the longitudinal length over at least one of said insulation sheets;

b. positioning a metallic shield including said thermosetting polyester adhesive coating over said drain wire and said insulation sheet, and;

c. bonding said metallic shield to said insulation sheet as a third function of time-temperature-pressure whereby solder bonding of said tined drain wires electrically bonds said tinned drain wire to said metallic shield.

12. The process of claim 11 wherein said third function is pressure at one hundred p.s.i. at a temperature 350° F. for one hour.

13. The process of claim 10 wherein metallic shields are bonded to opposing sides of said insulation sheets and a drain wire is electrically solder bonded to each of said metallic shields.

* * * * *